United States Patent [19]

Niven

[11] 4,310,869

[45] Jan. 12, 1982

[54] ELECTRIC FENCE ENERGIZER OUTPUT CONTROL CIRCUITS

[75] Inventor: Rex C. G. Niven, Hamilton, New Zealand

[73] Assignee: Gallagher Electronics Limited Company, Melville, New Zealand

[21] Appl. No.: 130,446

[22] Filed: Mar. 14, 1980

[30] Foreign Application Priority Data

Mar. 21, 1979 [NZ] New Zealand ..... 189958

[51] Int. Cl.[3] ..... H01T 20/00

[52] U.S. Cl. ..... 361/232

[58] Field of Search ..... 361/58, 156, 232, 235; 256/10; 323/239

[56] References Cited

U.S. PATENT DOCUMENTS 2,401,815 6/1946 Dalziel ..... 361/232 X 3,115,610 12/1963 Beguin ..... 256/10 X 4,114,185 9/1978 Gallagher ..... 361/232

*Primary Examiner*—Harry E. Moose, Jr.

*Attorney, Agent, or Firm*—Holman & Stern

[57] ABSTRACT

An electric fence energizer output control circuit to which is applied an output voltage from an electric fence energizer which voltage comprises sequential pulses having a short duration high voltage period and a longer duration low voltage period of opposite polarity. A control circuit comprising first and second rails, a triac connected in the first rail by the main terminals thereof, the triac being conductive during high voltage pulse periods. Means to sense the end of the current flow due to the high voltage pulse period and to cause current to flow in the gate terminal of the triac thereby maintaining the triac in the conductive state during the low voltage pulse period, the arrangement being such that on the application of a relatively low voltage and relative low frequency AC sinusoidal voltage to the output of said control circuit said triac is non-conductive to the AC voltage.

6 Claims, 6 Drawing Figures

FIG. 1
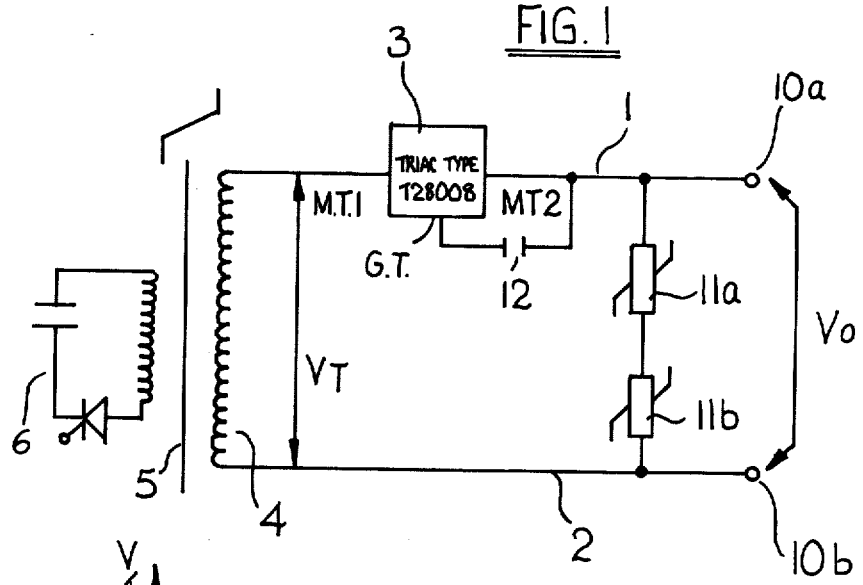
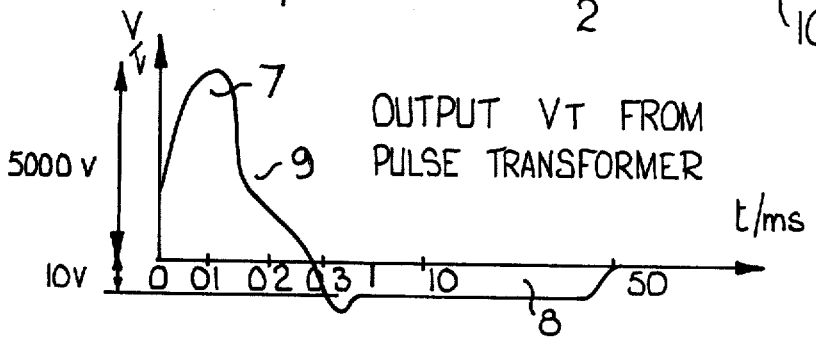
FIG. 2

ELECTRIC FENCE ENERGIZER OUTPUT CONTROL CIRCUITS

This invention relates to an electric fence energizer output control circuit.

In order to function satisfactorily an electric fence energizer must provide to the fence line a pulse of considerable energy and high current and, for example, a pulse of about 5000 volts is desirable which pulse is delivered at intervals such as about every 1100 milliseconds. In order to achieve a satisfactory energy input from the electric energizer to the fence it is desirable to have a low impedance output for the fence pulse to allow the pulse to be transferred from the energizer to the fence without substantial loss of energy.

However, it is also frequently necessary to provide a high impedance output particularly when the output circuit is faced with a 110 volts 60 hertz current. Typical examples are the requirement required by the Underwriters Laboratories Publication U.L. 69 and Canadian Safety Association's Specifications C22.2 No. 103.

Prior to the instant invention these requirements were frequently met by accepting a substantial energy loss on transfer of the pulse from the energizer to the fence. This is clearly undesirable.

It is therefore an object of the present invention to provide an electric fence energizer output control circuit which will go at least some distance towards overcoming the foregoing disadvantages or which will at least provide the public with a useful choice.

Accordingly the invention consists in an electric fence energizer output control circuit to which is applied an output voltage from an electric fence energizer which voltage comprises sequential pulses having a short duration high voltage period and a longer duration low voltage period of opposite polarity, said control circuit comprising first and second rails, a triac connected in said first rail by the main terminals thereof, said triac being conductive during high voltage pulse periods, means to sense the end of said current flow due to said high voltage pulse period and to cause current to flow in the gate terminal of said triac thereby maintaining said triac in the conductive state during said low voltage pulse period, the arrangement being such that on the application of the relatively low voltage and relative low frequency AC sinusoidal voltage to the output of said control circuit said triac is non-conductive to said AC voltage.

To those skilled in the art to which this invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

One preferred form of the invention will now be described with reference to the accompanying drawings in which:

FIG. 1 is a circuit diagram of an electric fence energizer output control circuit according to the preferred form of the invention.

FIG. 2 is a graphical representation of a typical output pulse from the output transformer of an electric fence energizer and to which the present invention particularly relates, FIGS. 3 to 5 show various alternative arrangements of a suitable output control circuit according to the invention, and FIG. 6 is a general block circuit for an electric fence energiser output control circuit according to the invention.

In the preferred form of the invention electric fence energiser output control circuit is provided as follows.

The output control circuit comprises a first rail 1 and a second rail 2 and a triac 3 for example a triac type T2800B connected by its main terminals MT1 and MT2 into the first rail 1.

The input ends of the rails 1 and 2 are connected to the secondary output 4 of the output transformer 5 of an electric fence energiser. The input to the transformer 5 is indicated by circuit 6.

The voltage pulse $V_f$ supplied by the secondary 4 of the transformer 5 is typically of the form shown in FIG. 2 having a short duration high voltage period 7 followed by a longer low voltage period 8. The period 7 reaches a voltage peak of preferably about +5000 volts and the voltage peak during the period 8 is typically of the order of 10 volts. The duration of this period 7 is typically about 0.3 milliseconds and the duration of the period 8 of the pulse is typically of the order of 50 milliseconds. At the changeover from the high voltage pulse period 7 to the low voltage pulse period 8 there is typically a rapid change of voltage which is shown in the area 9 of FIG. 2.

During the high voltage pulse period 7 the triac 3 is maintained conductive because its breakover voltage is exceeded and/or a sufficient gate current is supplied in the circuit of FIG. 1. The triac is made conductive and remains conductive until the current in it stops flowing. This property is essential to the invention. Also the high rate of charge of voltage during the increase of the high voltage pulse tends to turn the triac on as will the high gate current available to the triac. Thus during the high voltage period 7 an output voltage Vo will be provided at the output terminals 10*a* and 10*b* of the control circuit.

The output 10*a* and 10*b* may be connected by a suitable impedance such as voltage dependent resistors 11*a* and 11*b* (for example Philips part No. 2322 564900164) which limit the output voltage to less than 5 kv by in effect short circuiting the output at high voltages.

In order to maintain the triac conductive during the longer negative voltage period 8 means are provided to sense the end of the high voltage period 7 and these means preferably comprise an impedance such as capacitor 12 and referring to FIG. 1 this impedance is connected between the gate terminal of the triac GT and the rail 1.

During the change from the period 7 to the period 8 of the output pulse Vt a gate current is supplied which maintains the triac 3 in a conductive mode. This can be achieved by virtue of the rapid rate of change in the voltage between Mt1 and MT2 of triac 3 particularly close to the point where the triac current is instantaneously zero before becoming negative. During this period of rapid current change the charge across the capacitor 12 which capacitor typically has a value of 1 mF (0.001 mF) will vary thus causing gate current to flow making the triac "turn on" or be maintained in an "on" situation. During the long low voltage period the triac 3 is made conductive by initially causing a current to flow to the gate of the triac 3 as above described and thus at the beginning of the long negative pulse the triac 3 is in an "on" condition. Any attempt by the triac 3 to turn "off" will cause a rapid voltage change between MT1 and MT2 of the capacitor 12 which again will cause a current to appear at the triac gate GT. Any such "turn off" attempt will cause rapid changes and sufficient current will appear at the gate to maintain the triac 3 in an "on" condition. That is to say that sufficient gate current is supplied during any such rapid change in voltage to exceed the gate current required to turn or hold the triac 3 in a on condition and current continues to flow in the rail 1 thus holding the triac on.

Thus for pulses progressing from the output 4 to the output 10 the triac will be seen as "on" during both the high voltage period 7 and the low voltage period 8. If a sinusoidal alternating current main supply, for example 160 volts rms at 60 Hz is applied to the output terminals 10*a* and 10*b* the situation is different. In these circumstances the triac is not made conductive as seen from the output terminal as only a small current in particular less than 5 milliamps will flow between the terminals 10*a* and 10*b*. In this mode there is insufficient voltage, or gate current, or rates of change of voltage to turn the triac "on" for such pulses, having regard to the lower voltage of the sinusoidal voltage compared to the maximum output pulse as seen in FIG. 2. Also the sinusoidal voltage wave form has insufficient rates of change to turn the triac "on".

Alternatively connections through impedances alternative to the capacitor 2 could be provided or the connection can be made to other parts of the circuit such as the input and output of the transformer 5.

FIGS. 3 to 6 show some other possible circuits and FIG. 3 for example shows the circuit rearranged for use with negative polarity pulses.

In the circumstances MT1 and MT2 of the triac are reversed and the gate input is taken from the rail 1 between winding 4 and MT2.

In FIG. 4 the circuit is provided for positive pulses but resistors R1 and R2 are provided R1 being provided between the capacitor 12 and MT2 and R2 between the capacitor and the input MT1. The constructions is such as to limit the sensitivity of the triac 3 to transient applied to the output terminals 10*a* and 10*b*.

Thus any transient or any unexpected voltage peaks fed to the outputs 10*a* and 10*b* will not tend to turn the triac on when seen from the outputs 10*a* and 10*b* as the sensitivity of the triac to these transients has been reduced by provision of the resistors.

Figure 3:
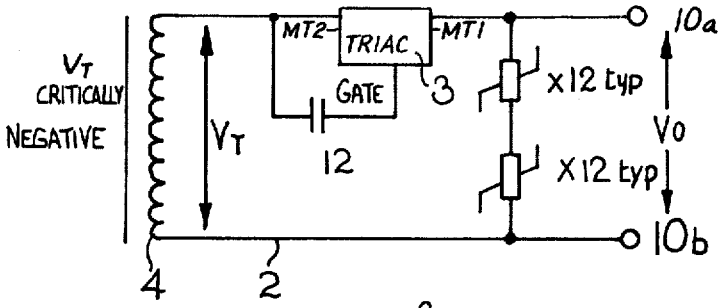
Figure 4:
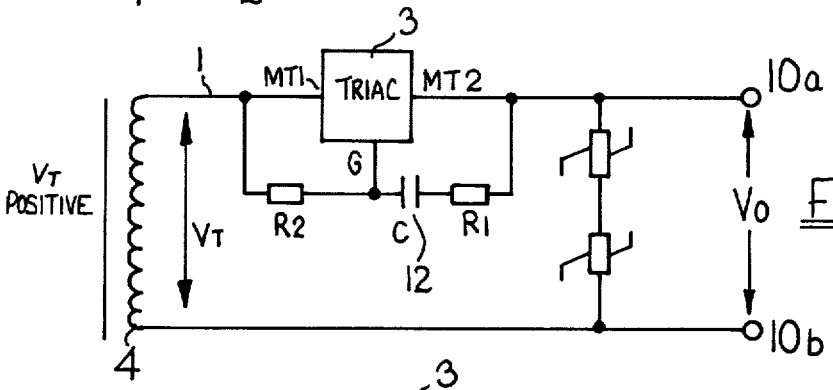
Figure 5:
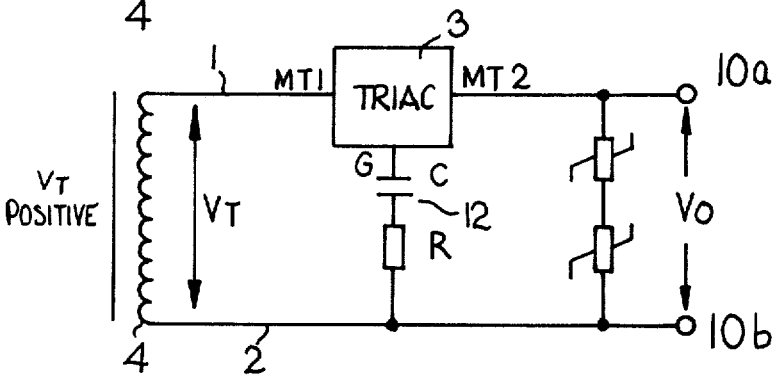
FIG. 5 shows a similar construction wherein the gate current is drawn from the rail 2 through compacitor 12 and resistor R. In this configuration the sensitivity to all voltages applied to the output terminals is reduced whether such voltages be transient or a sinusoidal voltage as above outlined.
Figure 6:
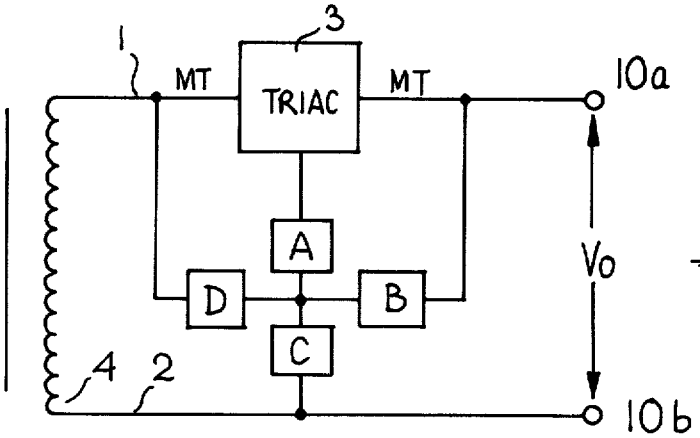
FIG. 6 shows a general circuit wherein each block A, B, C or D contains a passive electrical circuit such as, for example, the capacitors and resistors shown in FIGS. 1 and 3 to 5.

Each of the circuits in FIGS. 1 and 3 to 5 can be represented by the circuit in FIG. 6.

In use the control circuit described is connected to the output from an electric fence energizer output transformer in the manner described. This will allow the energizer to supply a voltage to the electric fence for example of the form shown in FIG. 2, this remains sinusoidal voltage for example 110 volts 60 cycle current is applied to the output of the control circuit through outputs 10*a* and 10*b* no current will flow, that is to say, there is a high impedance input when a connection to 110 volts 60 Hz current in particular is made by the terminals 10*a* and 10*b*.

Thus it can be seen that at least in the preferred form of the invention an electric fence energizer output control circuit is provided which will enable a low impedance output for the fence pulse to be obtained but a high impedance input when the output circuit is faced with for example 110 volts 60 Hz current. Thus the requirements required by the Underwriters Laboratories Publication News L69 in Canadian Safety Association Specification C22.2 No. 103 are met whilst the electric fence energiser still meets the usual requirement that the electric fence energiser provides a pulse considerably energy at high current. Also the use of the triac to meet this requirement enables the safety features to be achieved with only a small loss of the available energy of the electric fence pulse.

What I claim is:

1. An electric fence energizer output control circuit to which is applied an output voltage from an electric fence energizer which voltage comprises sequential pulses having a short duration high voltage period and a longer duration low voltage period of opposite polarity, said control circuit comprising first and second rails, a triac connected in said first rail by the main terminals thereof, said triac being conductive during high voltage pulse periods, means to sense the end of said current flow due to said high voltage pulse period and to cause current to flow in the gate terminal of said triac thereby maintaining said triac in the conductive state during said low voltage pulse period, the arrangement being such that on the application of a relatively low voltage and relative low frequency AC sinusoidal voltage to the output of said control circuit said triac is non-conductive to said AC voltage.

2. An electric fence energizer output control circuit as claimed in claim 1 wherein said means to sense the end of said high voltage pulse period senses a rapid change in voltage at the end of said high voltage pulse period.

3. An electric fence energizer output control circuit as claimed in claim 2 wherein said means to sense the end of said high voltage pulse period comprises an impedance connected between the triac gate terminal and either said first or said second rail.

4. An electric fence output control circuit wherein said impedance comprises a capacitor.

5. An electric fence output control circuit as claimed in claim 1 wherein one or more impedances are positioned between said first and second rails at the output ends thereof relative to said triac.

6. An electric fence output control circuit as claimed in claim 5 wherein said impedance or impedances between said first and second rail comprise voltage dependant resistors.

* * * * *